US010467863B2

(12) United States Patent
Lin

(10) Patent No.: US 10,467,863 B2
(45) Date of Patent: Nov. 5, 2019

(54) NO-COMMISSION, ASIAN STYLE BACCARAT

(71) Applicant: He Lin, Las Vegas, NV (US)

(72) Inventor: He Lin, Las Vegas, NV (US)

( * ) Notice: Subject to any disclaimer, the term of this patent is extended or adjusted under 35 U.S.C. 154(b) by 853 days.

(21) Appl. No.: 14/568,018

(22) Filed: Dec. 11, 2014

(65) Prior Publication Data

US 2015/0248820 A1 Sep. 3, 2015

Related U.S. Application Data

(63) Continuation-in-part of application No. 14/192,877, filed on Feb. 28, 2014, now abandoned.

(51) Int. Cl.
*G07F 17/32* (2006.01)

(52) U.S. Cl.
CPC ..... *G07F 17/3293* (2013.01); *G07F 17/326* (2013.01); *G07F 17/3244* (2013.01)

(58) Field of Classification Search
CPC . G07F 17/326; G07F 17/3293; G07F 17/3225
USPC ..... 463/11
See application file for complete search history.

(56) References Cited

U.S. PATENT DOCUMENTS 5,362,064 A * 11/1994 Lofink ..... A63F 3/00157 273/274
2008/0157473 A1* 7/2008 Au-Yeung ..... A63F 1/18 273/292
2011/0183753 A1* 7/2011 Acres ..... G07F 17/32 463/31

* cited by examiner

*Primary Examiner* — Omkar A Deodhar
*Assistant Examiner* — Wei Lee
(74) *Attorney, Agent, or Firm* — Newman Law, LLC

(57) ABSTRACT

Systems and methods for providing wagering games associated with Baccarat, including modified versions of Baccarat described herein, which are configured for receiving and determining the outcome of the wager for the associated game based on the satisfaction of at least one of the following: the banker hand score being four; the banker hand score being six and having three playing cards in the banker hand; and the banker hand score and player hand score both being six and both the player hand and banker hand having three playing cards; and the banker hand score being eight and both the banker hand and the player hand having three playing cards.

19 Claims, 6 Drawing Sheets

NO-COMMISSION, ASIAN STYLE BACCARAT

CROSS-REFERENCE TO RELATED APPLICATIONS

This application is a continuation in part and claims the benefit of U.S. Non-Provisional patent application Ser. No. 14/192,877, filed Feb. 28, 2014, the disclosure of which is incorporated herein by reference.

BACKGROUND OF THE INVENTION

Field of the Invention

The present invention relates to the field of gaming, particularly to the field of card games (both physical and electronic) and particularly to variations in the game of baccarat.

Background of the Art

Baccarat is one of the many live table games played in casinos or gaming establishments. Baccarat uses one or more standard decks of 52 playing cards and is usually dealt from a shoe having multiple decks that have been shuffled together prior to the beginning of play.

The object of the game of Baccarat is for the bettor to successfully wager on whether the Bank's hand or the Player's hand is going to win. The bettor receives even money for his wager if he selects the winning hand and loses his wager if he selects the losing hand. Because of the rules of play of Baccarat and more particularly the pre-established draw rules, the Bank's hand has a slightly higher chance of winning than does the Player's hand. The winning frequency for the Bank's hand has been determined to be 0.45859 (45.859%) whereas the winning frequency for the Player hand is 0.44624 (44.624%) with the remainder of the outcomes being ties. Therefore, if the bettor wagers on the Bank's hand and the Bank hand wins, the bettor must pay to the gaming establishment a commission (typically, 5%) of the amount the bettor wins. No commission is paid if the bettor successfully wagers on the Player's hand.

As used in this specification, the term "Conventional Manner of Play of Baccarat" is as follows:

A multiple number of decks of standard playing cards, 52 in number, are used; typically eight decks, or 416 playing cards, are shuffled together and placed in a shoe from which the cards are dealt during the play of the game.

Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten.

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and an eight total fifteen, but the hand value is five. An Ace and a nine total ten, but the hand value is zero.

A two card total of eight or nine is called a "natural"; a two card total of zero is called a "baccarat." As will be explained below, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each better can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total on nine is the winner.

All winning Bank hand wagers are paid off at odds of one-to-one and the house charges a five percent (5%) commission on the amount won by the bettor. For example, if a bettor wagers $100 on the Banker hand and the Banker hand wins, the bettor wins $100 and is charged a $5 commission on the amount that the bettor won.

All winning Player hand wagers are paid off at odds of one-to-one and the bettor is not charged any commission on the amount of his winnings or his wager because the house, by virtue of the third card draw rules, has a statistical advantage over the player of 45.859-44.624 or 1.235% which is the vigorish ("vig") of the house on player wagers. Winning wagers on the Tie hand bet are paid off at odds of nine-to-one or eight-to-one (depending on the gaming establishment) and the bettor is not charged any commission on the amount of his winnings or his wager since there is already a statistical advantage in favor of the house on tie wagers.

If a Tie hand occurs, all wagers on the Bank hand and all wagers on the Player hand are "pushes" and the amount wagered is returned to the bettor.

Depending on the point total of the Player's hand and the Banker's hand, an additional card may be dealt to either the Player's hand, the Banker's hand or both. The rules for determining whether a third card is dealt are fixed rules, there is no discretion for either the Player's hand or the Banker's hand on whether a third card is dealt.

If either the Player hand or the Banker hand has a point total of eight or nine on the first two cards, no third card is dealt to either hand and the hand with the highest point total is the winner (or the hand is a Tie, as the case may be). If neither the Player hand nor the Banker hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Banker hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

TABLE 1

| BACCARAT RULES | |
|---|---|
| PLAYER | |
| HAVING TWO CARD TOTAL OF | |
| 1-2-3-4-5-10 | DRAWS A CARD |
| 6-7 | STANDS |

TABLE 1-continued

| BACCARAT RULES | | |
|---|---|---|
| 8-9 | TURNS CARDS OVER | |
| BANKER | | |
| HAVING TWO CARD TOTAL OF | DRAWS WHEN GIVING OR PLAYER'S THIRD CARD DRAW IS AN | DOES NOT DRAW WHEN GIVING OR PLAYER'S THIRD CARD DRAW IS AN |
| 0, 1, 2 | ALWAYS DRAWS | |
| 3 | 1-2-3-4-5-6-7-9-10 | 8 |
| 4 | 2-3-4-5-6-7 | 1-8-9-10 |
| 5 | 4-5-6-7 | 1-2-3-8-9-10 |
| 6 | 6-7 | 1-2-3-4-5-8-9-10 |
| 7 | STANDS | |
| 8-9 | TURNS CARDS OVER | |

At the end of each hand, winning wagers are paid and losing wagers are collected by the house. Any commission due to the house is marked in commission boxes in the center of the table. Gaming chips are used to represent the amount of money owed by each bettor to the house for the commissions. In order not to slow down the game, the commission is not actually collected from each bettor until the end of the round determined by all of the cards in the shoe being dealt down to the plastic cut card, usually approximately eighty hands.

The mathematical analysis of the game reveals that the 5% commission is what gives the house its advantage on wagers on the Banker hand and allows the gaming establishment to make a profit from providing the Baccarat game to the bettors. Because the rules for standing and drawing third cards are automatic, the mathematical analysis shows that the Bank hand will win 45.859% of the hands, the Player hand will win 44.624% of the hands and the Tie hand will occur 9.517% of the hands. If the Tie hands are disregarded because they do not affect any Player or Bank wagers, it is then determined that the Bank hand will win 50.7% of the time and the Player hand will win 49.3% of the time.

Because the Bank hand wins more than 50% of the hands (disregarding the Tie hands that do not affect any Player or Bank wagers), if a bettor always bet on the Bank hand, the bettor would have an advantage over the gaming establishment. By charging a 5% commission on all Bank hand wins, the gaming establishment compensates for the percentage of winning Bank hands being slightly over 50%.

After figuring in the 5% commission that must be paid by bettors on winning Bank hands, the gaming establishment has approximately a 1.23% advantage over the bettor when the bettor wagers on the Player hand and the gaming establishment has a 1.057% advantage over the bettor when the bettor wagers on the Bank hand. The Tie hand wager gives the gaming establishment a 4.88% advantage over the bettor when the payoff odds are nine-to-one and a 14.1% advantage over the bettor when the payoff odds are eight-to-one.

One of the detriments of the conventional manner of play of Baccarat is the necessity for calculating, recording and collecting this 5% commission on all winning Bank hand wagers. Many people are reluctant to sit down and participate because they do not understand why they should have to pay a 5% commission on winning Bank hand wagers. They may consider this unfair and something extra for the gaming establishment.

The gaming establishments also suffer disadvantages from the 5% commission. The determination of the 5% amount is done visually by a casino dealer and is subject to casino dealer error and disputes with the bettors over the amount of the commission. The reconciliation and collection of the commission at the end of each shoe can result in delays of the beginning of the next round of play. If a bettor loses all of his money ("taps out") during a round of the game, the gaming establishment may have difficulty collecting the unpaid commission that has accrued to that bettor during that round of the game. It has been estimated that as much as twenty percent of the accrued commission goes uncollected. Because the house margin on Baccarat is so small, uncollected commissions can seriously impact the profitability of a Baccarat table or the entire Baccarat pit, if more than one table is in play. In certain situations a bettor will negotiate with the casino for the casino to forgive or discount the owed commissions, the quid pro quo being that the player will likely return to the casino in the future.

It has been desirable to eliminate commissions in baccarat, and this has been attempted in a number of different ways.

U.S. Pat. Nos. 5,979,896 and 5,362,064 (LoFink) disclose a modified method of playing either conventional Baccarat, or a modified Baccarat game with simplified draw rules is provided which can eliminate the commission charged to winning Bank hands by providing a partial payoff on one or more Bank winning outcomes. Further the method of the present invention can operate upon the Player hand as well to adjust the vigorish therefor. The method can be used to provide a no-commission game where the vigorish for the Bank and Player hands are substantially the same. Further the vigorish can be adjusted to at least partially fund a jackpot outcome.

U.S. Pat. Nos. 6,585,586 and 6,582,302 (Romero) describes a method and gaming assembly to play a variation of the game baccarat, the gaming assembly including a computer processor assembly, a display assembly and at least one user actuatable selector assembly. The computer processor assembly is structured to generate a player's hand and a banker's hand in accordance with rules of baccarat, one of those hands being designated the user's hand. Further, the computer processor assembly is structured to determine a winning hand in accordance with the rules of baccarat, designating the user as a winner if the user's hand is also the wining hand. Additionally, the computer processor assembly is structured to monitor consecutive ones of the user's hands and to indicate a bonus payout to the user in the event that consecutive ones of the user's hands have a final number count equal to a natural nine.

SUMMARY OF THE INVENTION

The invention is directed to systems and methods of providing, hosting and playing Baccarat and a wagering game associated with an underlying game of Baccarat.

Some embodiments of the invention are directed to a gaming method comprising the steps of: a) receiving a wager from a player relating to the associated wagering game in a designated area of a gaming table surface, wherein the wager is in the form of physical element representing a monetary amount; b) receiving Baccarat outcome data from an instance of conducting the underlying game of baccarat until a Baccarat outcome is achieved according to the rules of the Baccarat game, wherein the Baccarat outcome data includes a player hand score, a banker hand score, a number of playing cards in the player hand, and a number of cards in the banker hand; c) comparing the Baccarat outcome data with preset criteria for determining the outcome of the associated wagering game, wherein the preset criteria includes satisfaction of at least one of the following: the banker hand score being four; the banker hand score being six and having three playing cards in the banker hand; the banker hand score and player hand score both being six and both the player hand and banker hand having three playing cards; and the banker hand score being eight and both the banker hand and the player hand having three playing cards; d) facilitating the distribution of a payout to the player responsive to the preset criteria being satisfied by the Baccarat outcome data; and e) facilitating the collection of the wager responsive to the preset criteria not being satisfied by the Baccarat outcome data.

In some embodiments, the underlying game of Baccarat is modified such that outcome of a banker hand wager in the underlying game is a push responsive to the banker hand score being four and the player hand score being three or less.

In some embodiments, the underlying game of Baccarat is modified such that outcome of a banker hand wager in the underlying game is a win responsive to both the player hand and banker hand scores being eight and having two cards each.

In some embodiments, the underlying game of Baccarat is conducted using physical playing cards drawn from a randomly ordered group of standard physical playing cards. In other embodiments, the underlying game of Baccarat is conducted by using a random number generator mapped to simulate one or more decks of randomized standard physical playing cards.

In some embodiments, the collection of the wager comprises physically removing the element received from the designated area on the gaming table surface, and the distribution of a payout to the player comprises placing physical elements representing monetary amounts in the designated area of the gaming table surface.

Some embodiments of the invention are directed to a method of providing a Baccarat wagering game with associated wagering game with a player position in competition with a banker position, the player position and the banker position receiving playing cards from one or more decks of 52 playing cards, with eight decks, or 416 playing cards, being preferred, the method comprising:

detecting placement of an Baccarat wager from one or more participants, the Baccarat wager relating to the player position beating the banker position at the conclusion of a round of game play, the banker position beating the player position at the conclusion of the round of game play, or a tie between the player position and the banker position at the conclusion of the round of game play;

detecting placement of an associated game wager from one or more participants, the associated game wager relating to the play of an associated wagering game, wherein the preset criteria for determining the outcome of the associated wagering game includes satisfaction of at least one of the following: the banker hand score being four; the banker hand score being six and having three playing cards in the banker hand; the banker hand score and player hand score both being six and both the player hand and banker hand having three playing cards; and the banker hand score being eight and both the banker hand and the player hand having three playing cards;

providing two of the playing cards each to the player position and the banker position;

determining a value of each playing card provided during the round of play;

calculating a player position score based on a total value of the two physical playing cards provided to the player position and a banker position score based on a total value of the two playing cards dealt to the banker position;

determining whether an additional playing card will be provided to the player position based on the player position score and the banker position score, in accordance with the rules of Baccarat;

further determining whether an additional playing card will be provided to the banker position based on the player position score and the banker position score, in accordance with the rules of Baccarat;

resolving Baccarat wagers according to normal rules of Baccarat with at least one exception selected from the group consisting of:

no commission is collected when the banker hand wins;

when both player hand and banker hand have a natural 8, the banker hand wins; and when the banker hand final score is 4 and the player hand final score is 3 or less, a wager on the banker hand ties; and resolving associated game wagers through one of either distributing payout responsive to the preset criteria being satisfied by the Baccarat outcome or collecting the associated game wager detected.

In some embodiments of the aforementioned method, the step of detecting placement of an associated wager further comprises detecting placement of a first associated wager relating to one of either the banker hand score being four and detecting placement of a second associated wager relating to one of either the banker hand score being six and having three playing cards in the banker hand or the banker hand score and player hand score both being six and both the player hand and banker hand having three playing cards. A first payout may be distributed responsive to the satisfaction of the preset criteria of the banker hand score being six and having three playing cards in the banker hand and a second payout may be distributed responsive to the satisfaction of the preset criteria of the banker hand score and player hand score both being six and both the player hand and banker hand having three playing cards.

In some embodiments of the aforementioned method, a first payout is distributed responsive to the satisfaction of the preset criteria of the banker hand score being eight and both the banker hand and the player hand having three playing cards upon a Baccarat outcome of the banker hand score being greater than the player hand score, a second payout is distributed responsive to the satisfaction of the preset criteria of the banker hand score being eight and both the banker hand and the player hand having three playing cards upon an Baccarat outcome of the banker hand score being less than the player hand score, and a third payout is distributed responsive to the satisfaction of the preset criteria of the banker hand score being eight and both the banker hand and the player hand having three playing cards upon an Baccarat outcome of the banker hand score being the same as the player hand score. It should be understood that the payouts may differ, for example, the first payout may be greater than each of the second and third payouts.

Some embodiments of the invention are directed to systems for providing the above methods, which may include one or more data communication devices, display devices, and processing devices, which may be local or remote, as necessary to provide these methods on any computerized or partially computerized platforms, online or through a local or global communication network, including mobile devices, home computers, single or multiplayer electronic gaming machines enabling play with virtual or real currency and/or virtual or real playing cards, devices or kiosks for enabling wagering on the play of a live Baccarat game.

For example, some embodiments of the invention are directed to a system for providing a wagering game associated with an underlying game of Baccarat, comprising: a) a processor configured for determining the outcome of the associated wagering game based on comparing Baccarat outcome data received with a preset criteria, wherein the Baccarat outcome data received relates to an instance of conducting a Baccarat game until a Baccarat outcome is achieved, the Baccarat outcome data including a player hand score, a banker hand score, a number of playing cards in the player hand, and a number of cards in the banker hand from the instance of the Baccarat game, and wherein the preset criteria includes at least one of the banker hand score being four; the banker hand score being six and having three playing cards in the banker hand; the banker hand score and player hand score both being six and both the player hand and banker hand having three playing cards; and the banker hand score being eight and both the banker hand and the player hand having three playing cards; and b) a communication interface configured for: i) receiving a wager relating to the associated wagering game; ii) receiving Baccarat outcome data relating, wherein the baccarat outcome includes data relating to a player hand score, a banker hand score, the number of cards in the player hand, and the number of cards in the banker hand; iii) transmitting a notification that the wager is being collected responsive to none of the preset criteria being satisfied by the comparison of the Baccarat outcome data with the preset criteria; and iv) facilitating a payout responsive to any of the preset criteria being satisfied by the comparison of the Baccarat outcome data with the preset criteria.

In some embodiments of the aforementioned system, the processor conducts the underlying game of Baccarat until a Baccarat outcome is achieved according to the rules of the Baccarat game.

In some embodiments of the aforementioned system means for conducting the underlying game of Baccarat until a Baccarat outcome is achieved according to the rules of the Baccarat game is physical playing cards drawn from a randomly ordered group of standard physical playing cards.

The aforementioned system may further comprise a display configured for displaying the results of the wager in the associated wagering game.

In some embodiments, the communication interface and processor are mounted in a unitary housing.

Some embodiments of the invention are also directed to a non-transitory machine readable media for providing a wagering game associated with an underlying game of Baccarat including one or more software programs, code and/or data segments as necessary to provide any of the methods described herein on one or more machines.

DETAILED DESCRIPTION OF THE INVENTION

Figure 1:
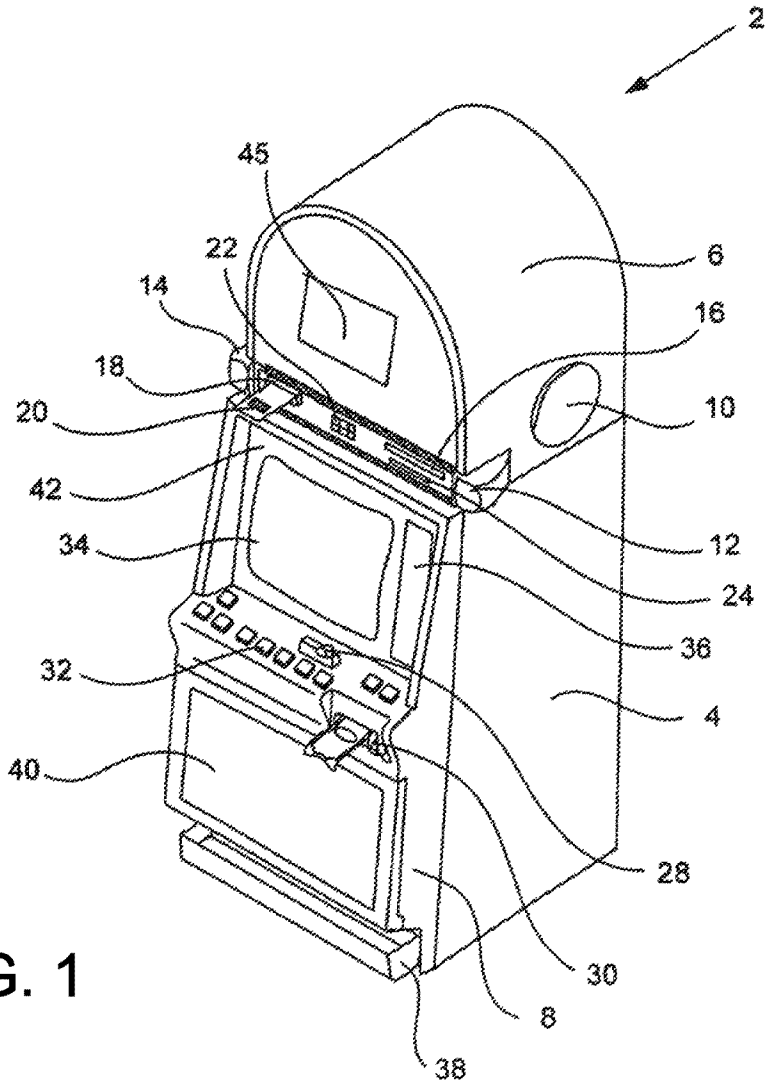
FIG. 1 shows a gaming machine on which the gaming method may be executed.

The invention is generally directed to methods of hosting a modified game of baccarat with physical playing cards or with an electronic system. The modified game of baccarat has a player position in competition with a banker position, the player position and the banker position receiving playing cards from one or more decks of 52 playing cards, with eight decks, or 416 playing cards, being preferred, the method comprising: detecting placement of an initial wager from one or more participants, the initial wager relating to the player position beating the banker position at the conclusion of a round of game play, the banker position beating the player position at the conclusion of the round of game play, or a tie between the player position and the banker position at the conclusion of the round of game play. Two of the cards from the at least one and preferably eight decks of 52 playing cards are provided to each to the player position and the banker position. Values of each playing card provided during the round of play are determined. A player position score is evaluated based on a total value of the two physical playing cards provided to the player position and a banker position score based on a total value of the two playing cards dealt to the banker position. It is determined whether an additional playing card will be provided to the player position based on the player position score and the banker position score, in accordance with the rules of baccarat; whether an additional playing card will be provided to the banker position in accordance with the rules of baccarat. Wagers according to normal rules of baccarat with at least one exception selected from the group consisting of:

no commission is collected when the banker hand wins;

when both player hand and banker hand have a natural 8, the banker hand wins; and when the banker hand final score is 4 and the player hand final score is 3 or less, a wager on the banker hand ties.

The eight decks may be a set of physical playing cards and two physical playing cards are provided to each of the banker hand position and the player hand position to form a first residual set of physical playing cards having 412 physical playing cards and then any additional physical playing card provided to the player position will be provided from the first residual set of physical playing cards to form a second residual set of physical playing cards having 411 physical playing cards. Any additional physical playing card dealt to the banker position is provided from the second residual set of physical playing cards.

The method may use a set of eight decks of virtual playing cards stored in memory in a processor which is configured to display virtual playing cards on a video display, and two virtual playing cards are provided to each of the banker hand position and the player hand position to form a first residual set of virtual playing cards in the memory having 412 physical playing cards and then any additional virtual playing card provided to the player position will be provided from the first residual set of virtual playing cards to form a second residual set of virtual playing cards having 411 virtual playing cards in memory. Any additional virtual playing card dealt to the banker position is provided from the second residual set of virtual playing cards. Gaming apparatus may comprise a processor, player input controls and a video display, wherein the processor is configured to execute the electronic virtual card method described herein.

Gaming apparatus comprising a gaming table having a randomized physical set of playing cards comprising 416 playing cards in a dealer shoe with only a back of one card displayed to live players, the gaming table configured to allow play of the physical playing card method described herein. Playing card shufflers or randomizers may be used in accordance with this method as further described herein.

The method may be played wherein one or more of the exceptions from normal wagering are used as where wagers are resolved according to normal rules of baccarat with three exceptions:

no commission is collected when the banker hand wins;

when both player hand and banker hand have a natural 8, the player hand wins; and when the banker hand final score is 4 and the player hand final score is 3 or less a wager on the banker hand ties.

The rules are further discussed below, including an analysis of the mathematics involved.

Further comparisons between traditional Baccarat and an exemplary embodiment of the invention (which is also referred to herein by the non-limiting game name of "888 Baccarat") are shown in the tables below. First is the "Banker 4" rule, which may be in operation after the player hand has a third card provided. If at that time the player has a count of 4 or less and the banker has a count of four, the banker hand may be allowed to stand.

| BANKER | PLAYER | Trad. BACCARAT | 888 BACCARAT | PLAYER SIDE |
|---|---|---|---|---|
| 4 | 4 | TIE | TIE | TIE |
| 4 | 3 | BANKER WINS | BANKER TIE | LOSE |
| 4 | 2 | BANKER WINS | BANKER TIE | LOSE |
| 4 | 1 | BANKER WINS | BANKER TIE | LOSE |
| 4 | 0 | BANKER WINS | BANKER TIE | LOSE |

The Mathematics in the Play of the Technology of the Present Invention.

Tie when Banker wins with 4

P (Banker Wins)=0.4585-0.0327=0.4258

EV(Banker Wins)=0.4258-0.4462=−0.0204

| Player | Banker | Player | Banker | Combinations | Possibility |
|---|---|---|---|---|---|
| 3 card | 2 card | 0 | 4 | 28,249,492,660,224 | 0.005652 |
| | | 1 | 4 | 26,104,503,730,176 | 0.005223 |
| | | 2 | 4 | 24,074,105,966,592 | 0.004816 |
| | | 3 | 4 | 24,155,341,135,872 | 0.004833 |
| | 3 card | 0 | 4 | 17,784,114,872,320 | 0.003558 |
| | | 1 | 4 | 14,488,507,043,840 | 0.002899 |
| | | 2 | 4 | 14,511,225,434,112 | 0.002903 |
| | | 3 | 4 | 13,992,499,290,112 | 0.002799 |
| | | | | | 0.032683 |

Tie when Banker wins with 4

EV(Banker)=−2.04%

Traditional Baccarat

EV(Banker)=−1.06%

2.04-1.06=0.98

These percentages may take out too much from the banker's side, so it is can be desirable to increase benefits to the player' hand to make the game more balanced. The following additional rule will help balance the odds.

If the banker has a two-card 8 (Natural 8) and the player also has a natural 8

Banker's side gets paid 1 to 1.

Player's side goes to TIE

The tabulated rules for this play are:

| BANKER | PLAYER | Trad. BACCARAT | 888 BACCARAT | PLAYER SIDE |
|---|---|---|---|---|
| Natural 8 | Natural 8 | TIE | WIN | TIE |
| 3-Card 8 | 3-Card 8 | TIE | TIE | TIE |

The mathematics for the combined rules are:

P (Banker Wins)=0.4258+0.0089=0.4347

EV(Banker Wins)=0.4347-0.4462=−0.0115=−1.15%

| Player | Banker | Player | Banker | Combinations | Possibility |
|---|---|---|---|---|---|
| 2 Card | 2 Card | 8 | 8 | 44,487,098,110,464 | 0.0089 |

A comparison of the mathematics between traditional baccarat and 888-Baccarat™ game is:

| | Traditional Baccarat | 888 Baccarat |
|---|---|---|
| P (Banker Wins) | 0.3452 | 0.4344 |
| EV (Banker Wins) | −1.06% | −1.15% |

In comparison with what is known in the art as EZ Baccarat™ game, the math comparison is:

| | Traditional Baccarat | 888 Baccarat | EZ Baccarat ™ Game |
|---|---|---|---|
| HA (Banker) | 1.06% | 1.15% | 1.10% |
| HA (Player) | 1.24% | 1.24% | 1.24% |

It should understood that the invention is generally directed to systems, methods and apparatus for providing, operating, hosting and conducting interactive wagering games which involve a sequence of controlled and concrete transformative events or steps, including the generation and application of random data. In some embodiments, the invention includes steps involving the receipt of wagers, the random generation of playing cards, the distribution of the randomly generated playing cards to form hands of cards, the application of procedures and rules, the comparison of the hands with preset criteria relating to game play and the outcome of the wager, determining the outcome of the wagers and collecting the wagers or distributing payouts depending on the determined outcome.

It should be further understood that the words "wager," "wagering," "betting" or "bet," or the like, refers to any type of points, money, credits, items of value, including physical or virtual representations thereof, which are placed at stake in that they may be forfeit depending on the occurrence of machine-generated randomly generated outcomes, such as outcomes which may be provided by revealing physical playing cards drawn from one or more decks or groups of randomly-ordered physical playing cards or a random number generator for randomly generating numbers which can be mapped to identify playing card results.

Figure 2:
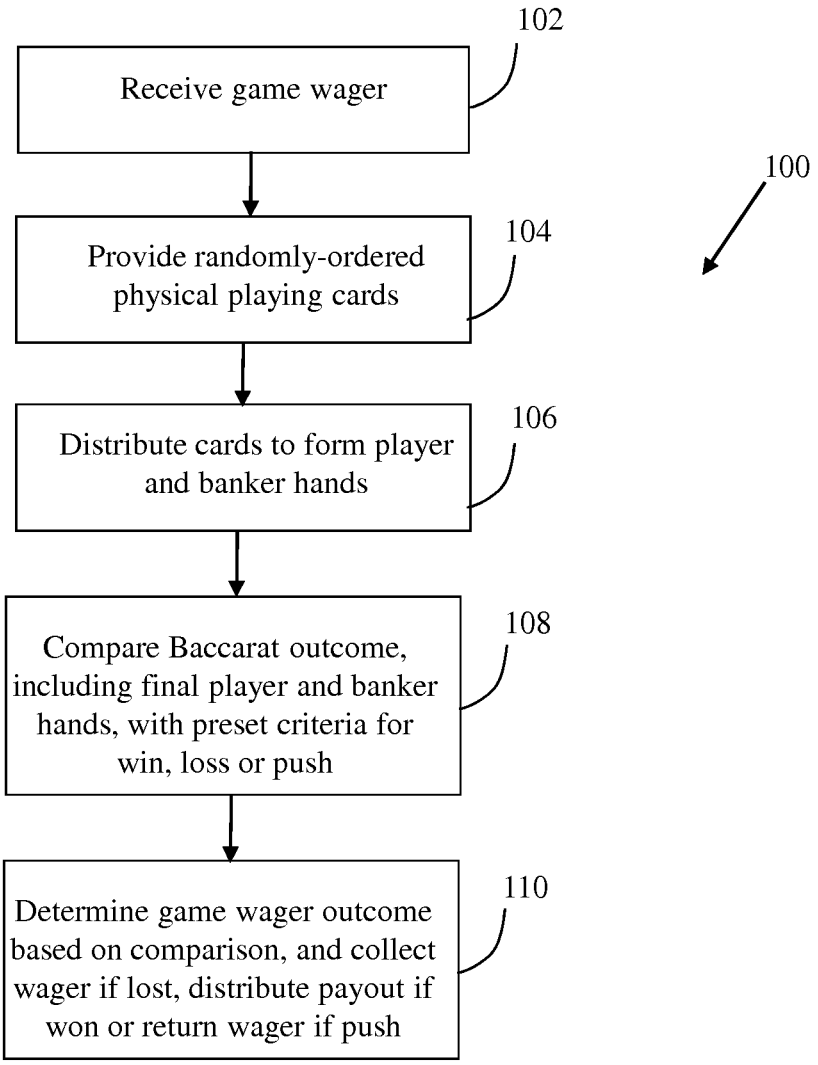
FIG. 2 is a flow diagram illustrating a gaming method configured in accordance with some embodiments of the invention.

FIG. 2 illustrates a flowchart diagram of a no-commission baccarat wagering game method of the invention generally referred to as method 100. Method 100 includes a step 102 of receiving a game wager from individual players, which includes the positioning of physical elements which represent monetary amounts (e.g., tokens or chips) in a designated area on the surface of a physical gaming table. The gaming table surface may include various areas designated thereon for placing wagers, including a banker side wager and a player side wager, and for placing physical cards distributed to form the player and banker hands. Thus, receiving a game wager can include placing a physical element in a designated area on the surface of the physical gaming table. For example, a physical element being placed on the designated area for a banker side wager comprises receiving a wager on a baccarat outcome in which the banker hand outranks the player hand, and a physical element being placed on the designated area for a player side wager comprises receiving a wager on a baccarat outcome in which the player hand outranks the banker hand. At step 104, one or more decks of randomly-ordered standard physical playing cards are provided for use in method 100.

At step 106, randomly-ordered physical playing cards are distributed from the one or more provided decks to the designated areas for the player hand and banker hand until final scores for the player hand and the banker hand are achieved in accordance with the rules of Baccarat. Thus, in this embodiment, step 106 includes the steps of distributing two physical playing cards from the one or more provided randomly-ordered decks to form the player hand at a player hand position defined on the gaming table and distributing two physical playing cards from the one or more provided randomly-ordered decks to form the banker hand at a banker hand position on the gaming table, as well as the steps of distributing additional physical playing cards from the one or more randomly ordered decks to the player and banker hands as required by the rules of Baccarat to obtain a final score for both the player and banker hands.

At step 108, the Baccarat outcome, that is, the final player hands and banker hands and associated scores, are compared with preset criteria for determining the outcome of the game wager received in step 102 depending on which of the player or banker sides the game wager was placed.

In some embodiments, the preset criteria sets forth that any wager placed in the designated player side wins if the player hand outranks the dealer hand, which as set forth herein, occurs when the Baccarat outcome is the player hand score being greater than the banker hand score according to the rules of Baccarat. In some embodiments, the preset criteria sets forth that any wager placed in the designated banker side wins if the banker hand outranks the player hand, which as set forth herein, occurs when the Baccarat outcome is the banker hand score being greater than the player hand score according to the rules of Baccarat, or upon the player hand and banker hand both being Natural 8s (that is, the player hand score and banker hand scores are both eight and each of the hands consist of two cards), unless the banker hand score is four and the player hand score is equal to any one of three, two, one or zero. In some embodiments, the preset criteria sets forth that any wager placed in either the designated banker side area or the designated player side area is a push when the Baccarat outcome is either one of the following conditions: i) the banker hand score and player hand score are either the same, unless the banker hand score and player hand score are both eight and consist of two cards each (that is, Natural 8s), in which case any banker hand wagers are won while any player hand wagers push; and ii) the banker hand score is equal to four and the player hand score is equal to any one of three, two, one or zero.

In the exemplary embodiment of method 100, the preset criteria sets forth the rules of Baccarat for determining the outcome of the wagers, except that wagers placed in the player side designated area win instead of push if both the player and banker hands constitute a natural 8, and wagers placed in the banker side designated area push instead of win if the banker hand score is four and the player hand final score is one of three, two and one.

At step 110, the outcome of the game wager is determined based on the satisfaction of the preset criteria. Game wagers are either physically removed from the designated area if lost, returned by physically moving to a player or player position if pushed, or payouts are physically distributed if the game wagers are won.

Figure 3:
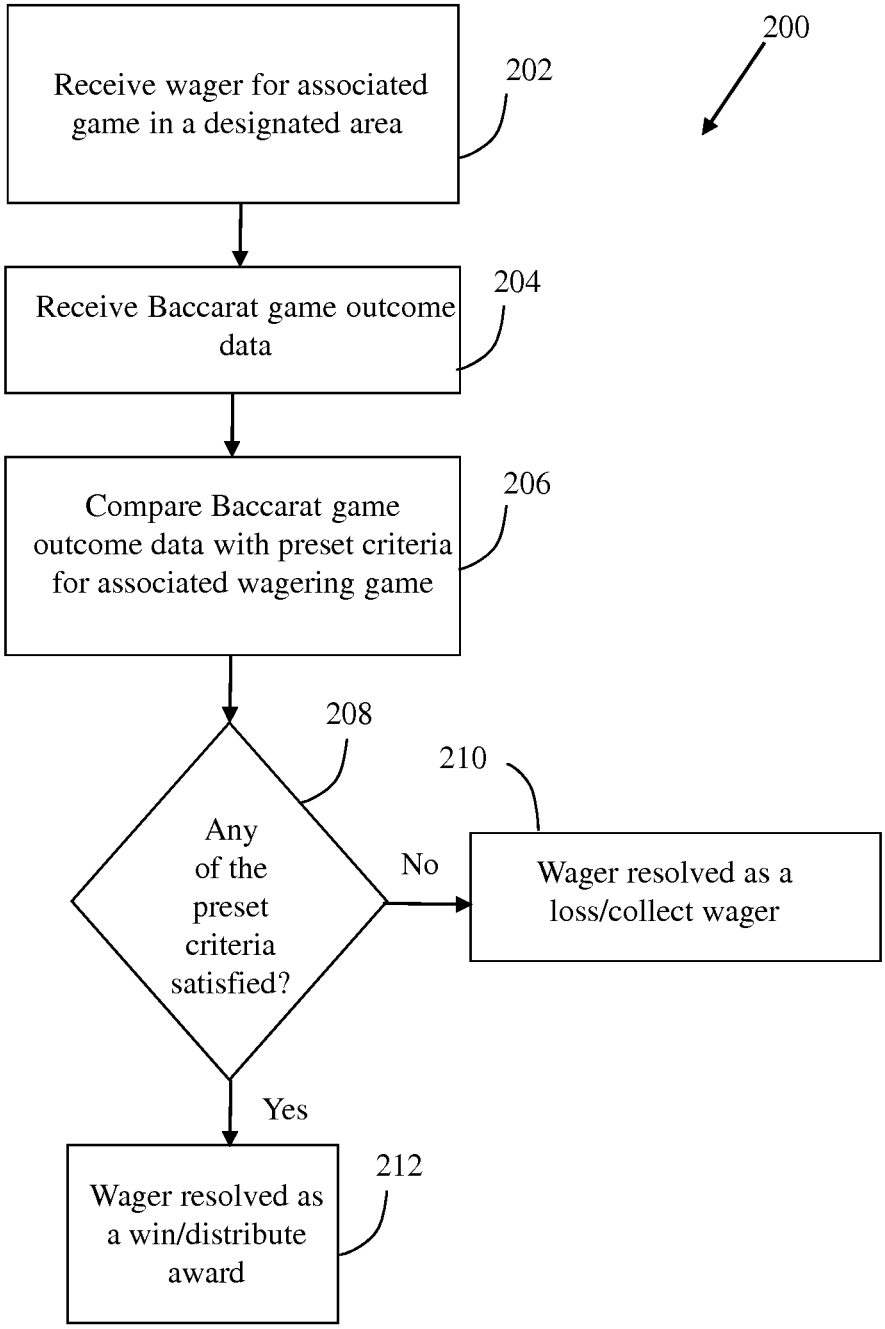
FIG. 3 is a flow diagram illustrating a gaming method for a wagering game associated with the game of Baccarat which is configured in accordance with some embodiments of the invention.

In another embodiment of the invention, one or more wagers may be placed in a side or secondary game associated with the game of Baccarat, modified Baccarat games, no-commission Baccarat games, such as the wagering game of method 100, which is generally referred to by the reference numeral 200 in FIG. 3.

In step 202, one or more associated game wagers are received by a player interested in playing an associated game. Receiving the associated game wagers may involve placing a physical element representing a monetary value in a designated area on the surface of a game table, as described above.

In this embodiment, the associated game wager is optional, and may be received along with a wager in the underlying game of Baccarat. However, in other embodiments, the associated game wager placed in step 202 may be mandatory, along with a Baccarat game wager received in the underlying game, so that the player must place a Baccarat wager and a wager in the associated game. Alternatively, a wager in the underlying game of Baccarat is required for a player to be eligible to place a wager in the associated game in step 202.

In step 204, the underlying Baccarat game is played or operated until an outcome is achieved according to the rules of the underlying game. For example, Baccarat according to method 100 may be played which will result in the formation of a player hand and a banker hand through the delivery of random playing cards that may be physically dealt from a shoe containing a stock of randomized cards or virtually supplied via a program using a random number generator. The Baccarat game continues until a player hand win, banker hand win or tie is determined as the Baccarat outcome. It should be understood the Baccarat game outcome may be communicated and received from a physical gaming table and used in the associated game of method 200 at the table, online or otherwise to facilitate the remote play of the associated game in combination with a live table game. It should be further understood that the underlying game and associated game may be conducted at the same or different locations.

In step 206, data from the Baccarat game is compared with preset criteria for resolving the wager received in connection with the associated wagering game in step 202. The Baccarat game outcome obtained in step 204 may be stored in memory, if transmitted for example, or otherwise made immediately available and displayed through physical cards or on a monitor for purposes of conducting the comparison of step 206.

In this embodiment, the preset criteria of the associated game relates to one of the following, which may be associated with one or more individual side wagers: the banker hand score being four, irrespective of the number of playing cards in the banker hand; the banker hand score being six and the banker hand including three playing cards; and the banker hand score and player hand score both being six and both hands including three playing cards. For example, a side wager may be received in step 202 which corresponds with the preset criteria of banker hand score being four, and a separate side wager may be received in step 202 which corresponds with the remaining preset criteria relating to the banker hand score being six and the banker hand including three playing cards or tie between banker hand and player hand, with each having three cards and a score of six.

In another embodiment, the preset criteria of the associated game, for which one or more individual side wagers may be received, relates to Baccarat game data indicating that both the player and banker hand received three cards, respectively, and the banker hand score is eight. If this preset criteria is satisfied, a payout award may be provided depending on the Baccarat game outcome, that is, whether the three card banker hand with a score of eight won, tied or lost to the three card player hand. For example, if the banker and player hands both received three cards and the banker hand score is eight, payouts may be awarded to players from which a wager on this associated game was received as follows: a payout of 40 to 1 for a banker hand win; a payout of 20 to 1 for a banker hand and player hand tie; and a payout of 20 to 1 for a banker hand loss.

As shown by step 208, if the data obtained from the underlying game outcome does not satisfy any of the preset criteria for the associated wagering game, then the outcome of the associated game wager is determined to be a loss and any wager received in step 202 is collected in step 210.

As also shown by step 208, if the data obtained from the underlying game outcome satisfies any of the preset criteria for the associated wagering game, then the outcome of the associated game wager received in step 202 is determined to be a win, and a payout award is provided in step 212. The payout in step 212 may be anything of value, such as a fixed amount, a multiple of the wager received in step 212, an odds-based payout, all or a portion of an incremented progressive award or a prize.

In some embodiments of method 200, the preset criteria are divided into a first associated game wager or second associated game wager, either or both of which may be received in step 202. The outcome of the first associated game wager corresponds to the comparison of the preset criteria of the banker hand score being four in step 206. Upon placing the first associated game wager and satisfying the preset criteria in step 206, a first associated game wager payout will be made in step 212. The first associated game wager payout may be expressed as a multiple of the unit wager, such as 26 to 1. In this embodiment, the outcome of the second associated game wager corresponds to the comparison of the preset criteria of the banker hand including three playing cards and a score of six, and the banker hand and player hand both including three cards and a tying score of six in step 206. A second associated game wager payout is made in step 212 if the banker hand includes three playing cards and has a score of six, and an enhanced second associated game wager payout is made in step 212, which is higher than the first payout, if the banker hand and player hand both include three cards each and a tying score of six. The second associated game wager payout may be expressed as a multiple of the wager, such as 40 to 1, and the enhanced associated game wager payout may be 100 to 1.

Figure 4:
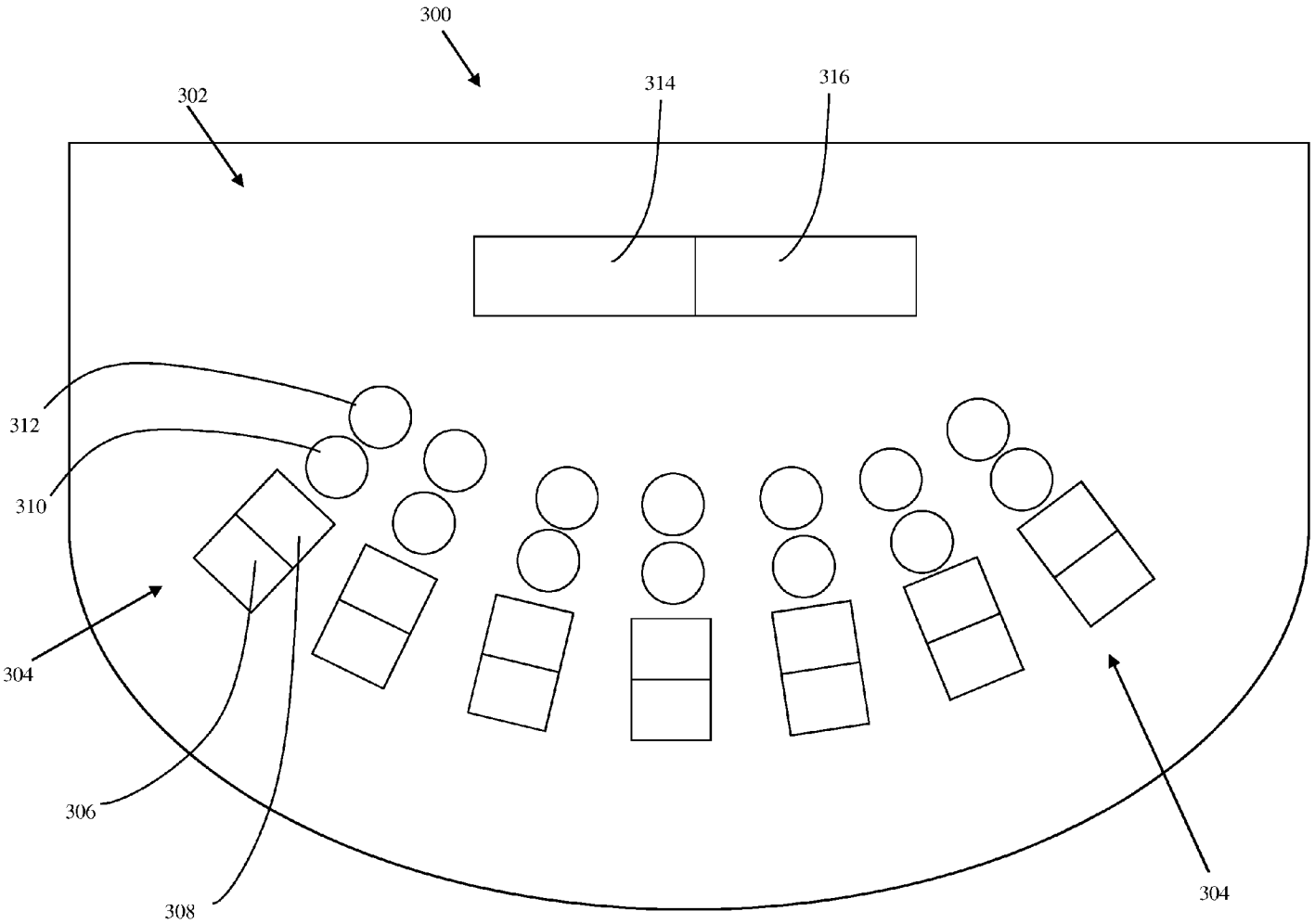
FIG. 4 shows an exemplary game table surface and layout including designated areas for use with an underlying Baccarat game, such as the modified Baccarat gaming method described herein, and an associated wagering game of the invention.

FIG. 4 illustrates a live or virtual gaming table surface 300 configured for operating in accordance with embodiments of the invention. Gaming table surface 300 includes a layout 302 for use in facilitating the presentment and display of a method of the invention such as method 200. Layout 302 may be a physical or virtual representation of a felt table display, as it should be understood that the methods of the invention would function as described herein if any one or more of the layout, cards, dealers or wagering chips or apparatus were virtually or physically represented. Layout 302 includes multiple player positions or interfaces 304. Each player position 304 may include designated Baccarat wagering areas 306 and 308, for wagering in the underlying game of Baccarat, which may be no-commission Baccarat as described herein, such as by method 100, along with a designated first associated game wagering area 310 and a designated second associated game wagering area 312 for wagering on the portions of preset criteria as set forth by the preceding paragraph and in method 200. Layout 302 may further include a player hand designated area 314 and a banker hand designated area 316. It should be understood that layout 302 is a non-limiting example which may be modified in accordance with the invention and include additional areas and information.

Computer-Based Implementations

Methods of the present invention may be implemented in computer hardware, software, or computer hardware and software. A most common form of computer implementation is a stand-alone, single player electronic gaming machine with electronic player controls and one or more video output screens.

In computer-based embodiments, the gaming device preferably includes at least one processor, such as a microprocessor, a microcontroller-based platform, a suitable integrated circuit or one or more application-specific integrated circuits (ASIC's) or Field Programmable Gated Arrays (FPGA's). The processor is in communication with or operable to access or to exchange signals with at least one data storage or memory device, and/or a player monitor or monitors. In one embodiment, the processor and the memory device reside within the cabinet of a gaming device. Multiple gaming devices are typically connected to a casino information network.

The memory device stores program code and instructions, executable by the processor, to control the gaming device. The memory device also stores other data such as image data, event data, player input data, random or pseudo-random number generators, pay-table data or information, House Ways distributions and applicable game rules that relate to the play of the gaming device. In one embodiment, the memory device includes random access memory (RAM): which can include non-volatile RAM (NVRAM): magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device.

In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. The gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "processor" or "computer" or "controller" or "game controller" and may include or be operatively associated with a random number generator or program for providing random numbers that can be mapped to standard playing cards in order to simulate dealing cards from one or more randomly-ordered deck of cards.

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome. It is also possible for templates or weighted templates of sets of tiles or paylines as disclosed in U.S. Pat. Nos. 6,159,096 and 6,117,009 (Yoseloff, which are incorporated by reference in their entirety) which disclose a method of configuring a video output gaming device to randomly generate game outcomes. The method includes the steps of selecting a set of game symbols, assigning a probability of occurrence to each symbol, selecting a plurality of outcome templates, each template comprising X variables, selecting a probability of occurrence for each outcome template, assigning a subset of symbols from the set of game symbols to each template for filling the positions, defining payouts for selected outcomes, and configuring a video output gaming device, which randomly selects a template, randomly selects a symbol for each variable in the template from the subset of game symbols assigned to the selected template, randomly fills at least a portion of the positions in the template and displays the outcome on a video output display. A video output gaming device programmed to randomly select a template, randomly select symbols to define the variables and randomly display the selected symbols is also disclosed.

In one embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master™ gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, PC practice play, hand-held game devices, wireless gaming devices and the like.

Chipless Gaming Table Implementation

One enabling system useful in the practice of the present invention is the use of playing cards with Chinese domino symbols which can be distributed for use with a system marketed under the name i-TABLE™ by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six™ shuffler, Ace™ shuffler, I-DEAL™ shuffler, I-SHOE™ delivery shoe, etc.); d) a processor receiving information (numbers of cards, rank of cards, suits of cards, etc.) from the card reading and delivery systems; e) communication connectivity (hardwired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game rules, hand history, and the like.

With regard to software f), it is understood in the practice of the present technology that this is not complex software that reads individual player hand cards and determines advantageous card distributions for a first time by extensive calculations. Rather, the entire range of possibilities of hands (e.g., all possible five card sets dealt to players in poker-style games) is known in poker style games.

A preferable card handling device for administering a video reel-type-style game is a hand-forming shuffler with integrated card recognition technology, from which playing cards are supplied, with a least a rank/count (and preferable also suit) of individual packs of cards are known before the cards are removed and delivered to player positions and/or the banker position. The card delivery system is in communication with the controller by wired or wireless communication methods. Communication between the various system components is not limited to electronic or electrical signals, but may include optical signals, audio signals, magnetic transmission or the like.

The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

Turning next to FIG. 1, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a display area including a mechanical gaming system (or less preferably a separate electronic game) 40. There may be an overlay of touchscreen functionality on the separate electronic game 40 or some of the buttons 32 may be functional on the separate mechanical gaming system 40. That separate mechanical gaming system may be in a relatively vertical viewing position as shown or in a more horizontal (table like) display unit. Viewable through the main door is a video display monitor 34 and an information panel 36. The display monitor 34 will typically be a cathode ray tube, high resolution flat-panel LCD, LED, plasma screen or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or nonprogressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in the FIG. 1. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating property.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding anew device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog tinier will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

Gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modem general-purpose computers include voltage monitoring circuitry, these types of circuits only report voltage status to the operating software. Out of tolerance voltages can cause software malfunction, creating a potential uncontrolled condition in the gaming computer. Gaming machines typically have power supplies with tighter voltage margins than that required by the operating circuitry. In addition, the voltage monitoring circuitry implemented in gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for slot machine game software is to use a state machine. Different functions of the game ((yet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc. that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, the Netplex™ system of IGT is a proprietary communication protocol used for serial communication between gaming devices. As another example, SAS is a communication protocol used to transmit information, such as metering information, from a gaming machine to a remote device. Often SAS is used in conjunction with a player tracking system.

Gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into a gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in a gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may he accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 1, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights within the separate mechanical (or electronic) separately, individually wagerable gaming system 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1A:
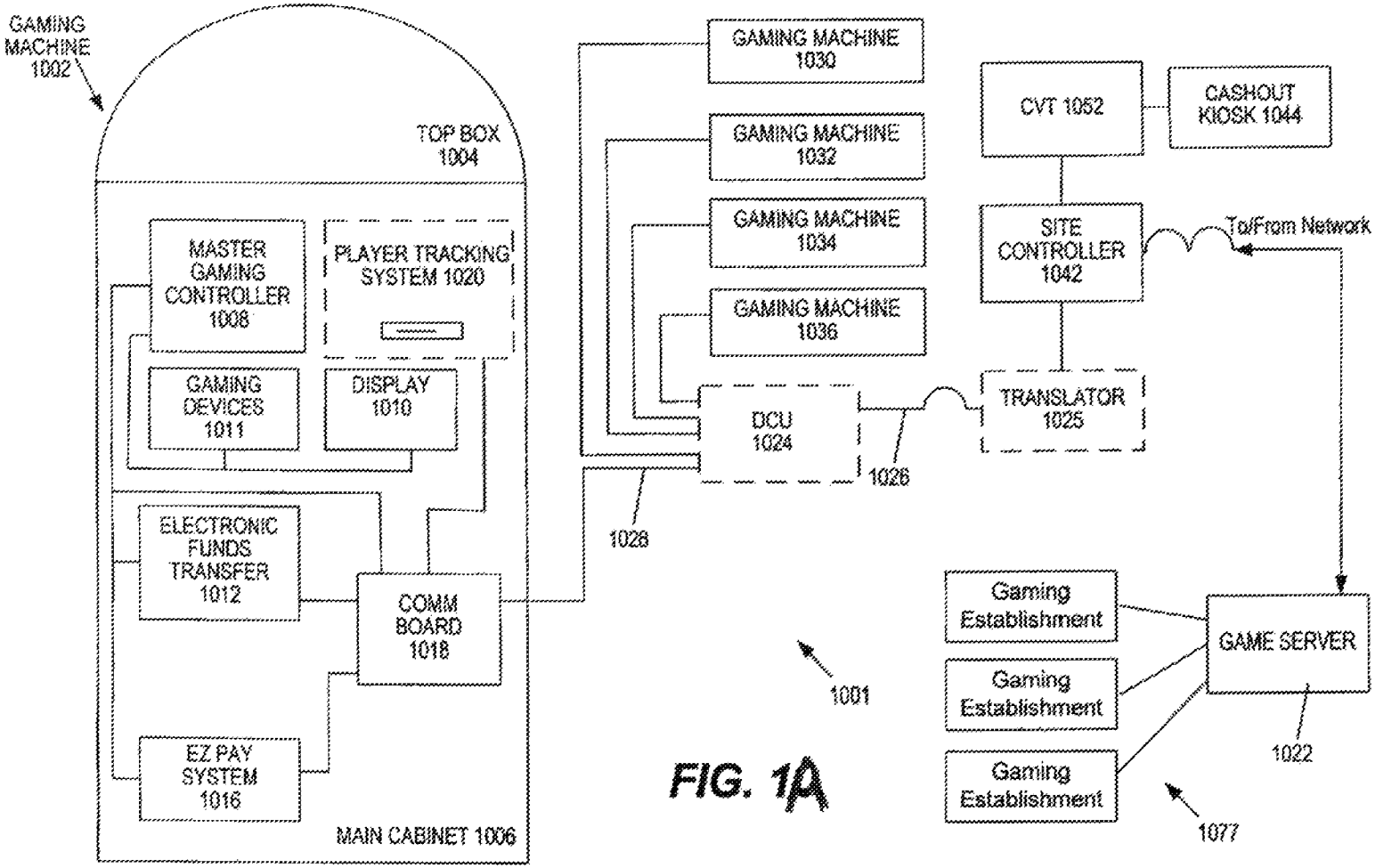
FIG. 1A shows a schematic for an electronic system for enabling play of the gaming method described herein.

Another gaming network that may be used to implement some aspects of the invention is depicted in FIG. 1A. Gaming establishment 1001 could be any sort of gaming establishment, such as a casino, a card room, an airport, a store, etc. In this example, gaming network 1077 includes more than one gaming establishment, all of which are networked to game server 1022. Here, gaming machine 1002, and the other gaming machines 1030, 1032, 1034, and 1036, include a main cabinet 1006 and a top box 1004. The main cabinet 1006 houses the main gaming elements and can also house peripheral systems, such as those that utilize dedicated gaming networks. The top box 1004 may also be used to house these peripheral systems.

The master gaming controller 1008 controls the game play on the gaming machine 1002 according to instructions and/or game data from game server 1022 or stored within gaming machine 1002 and receives or sends data to various input/output devices 1011 on the gaming machine 1002. In one embodiment, master gaming controller 1008 includes processor(s) and other apparatus of the gaming machines described above. The master gaming controller 1008 may also communicate with a display 1010.

A particular gaming entity may desire to provide network gaming services that provide some operational advantage. Thus, dedicated networks may connect gaming machines to host servers that track the performance of gaming machines under the control of the entity, such as for accounting management, electronic fund transfers (EFTs), cashless ticketing, such as EZPay™, marketing management, and data tracking, such as player tracking Therefore, master gaming controller 1008 may also communicate with EFT system 1012, EZPay™ system, and player tracking system 1020. The systems of the gaming machine 1002 communicate the data onto the network 1022 via a communication board 1018.

It will be appreciated by those of skill in the art that embodiments of the present invention could be implemented on a network with more or fewer elements than are depicted in FIG. 1A. For example, player tracking system 1020 is not a necessary feature of some implementations of the present invention. However, player tracking programs may help to sustain a game player's interest in additional game play during a visit to a gaming establishment and may entice a player to visit a gaming establishment to partake in various gaming activities. Player tracking programs provide rewards to players that typically correspond to the player's level of patronage (e.g., to the player's playing frequency and/or total amount of game plays at a given casino). Player tracking rewards may be free meals, free lodging and/or free entertainment. Player tracking information may be combined with other information that is now readily obtainable by an SBG system.

Moreover, DCU 1024 and translator 1025 are not required for all gaming establishments 1001. However, due to the sensitive nature of much of the information on a gaming network (e.g., electronic fund transfers and player tracking data) the manufacturer of a host system usually employs a particular networking language having proprietary protocols. For instance, 10-20 different companies produce player tracking host systems where each host system may use different protocols. These proprietary protocols are usually considered highly confidential and not released publicly.

Further, gaming machines are made by many different manufacturers. The communication protocols on the gaming machine are typically hard-wired into the gaming machine and each gaming machine manufacturer may utilize a different proprietary communication protocol. A gaming machine manufacturer may also produce host systems, in which case their gaming machines are compatible with their own host systems. However, in a heterogeneous gaming environment, gaming machines from different manufacturers, each with its own communication protocol, may be connected to host systems from other manufacturers, each with another communication protocol. Therefore, communication compatibility issues regarding the protocols used by the gaming machines in the system and protocols used by the host systems must be considered.

A network device that links a gaming establishment with another gaming establishment and/or a central system will sometimes be referred to herein as a "site controller." Here, site controller 1042 provides this function for gaming establishment 1001. Site controller 1042 is connected to a central system and/or other gaming establishments via one or more networks, which may be public or private networks. Among other things, site controller 1042 communicates with game server 1022 to obtain game data, such as ball drop data, bingo card data, etc.

In the present illustration, gaming machines 1002, 1030, 1032, 1034 and 1036 are connected to a dedicated gaming network 1022. In general, the DCU 1024 functions as an intermediary between the different gaming machines on the network 1022 and the site controller 1042. In general, the DCU 1024 receives data transmitted from the gaming machines and sends the data to the site controller 1042 over a transmission path 1026. In some instances, when the hardware interface used by the gaming machine is not compatible with site controller 1042, a translator 1025 may be used to convert serial data from the DCU 1024 to a format accepted by site controller 1042. The translator may provide this conversion service to a plurality of DCUs.

Further, in some dedicated gaming networks, the DCU 1024 can receive data transmitted from site controller 1042 for communication to the gaming machines on the gaming network. The received data may be, for example, communicated synchronously to the gaming machines on the gaming network.

Here, CVT 1052 provides cashless and cashout gaming services to the gaming machines in gaming establishment 1001. Broadly speaking, CVT 1052 authorizes and validates cashless gaming machine instruments (also referred to herein as "tickets" or "vouchers"), including but not limited to tickets for causing a gaming machine to display a game result and cash-out tickets. Moreover, CVT 1052 authorizes the exchange of a cashout ticket for cash. These processes will be described in detail below. In one example, when a player attempts to redeem a cash-out ticket for cash at cashout kiosk 1044, cash out kiosk 1044 reads validation data from the cashout ticket and transmits the validation data to CVT 1052 for validation. The tickets may be printed by gaming machines, by cashout kiosk 1044, by a stand-alone printer, by CVT 1052, etc. Some gaming establishments will not have a cashout kiosk 1044. Instead, a cashout ticket could be redeemed for cash by a cashier (e.g. of a convenience store), by a gaming machine or by a specially configured CVT.

Figure 1B:
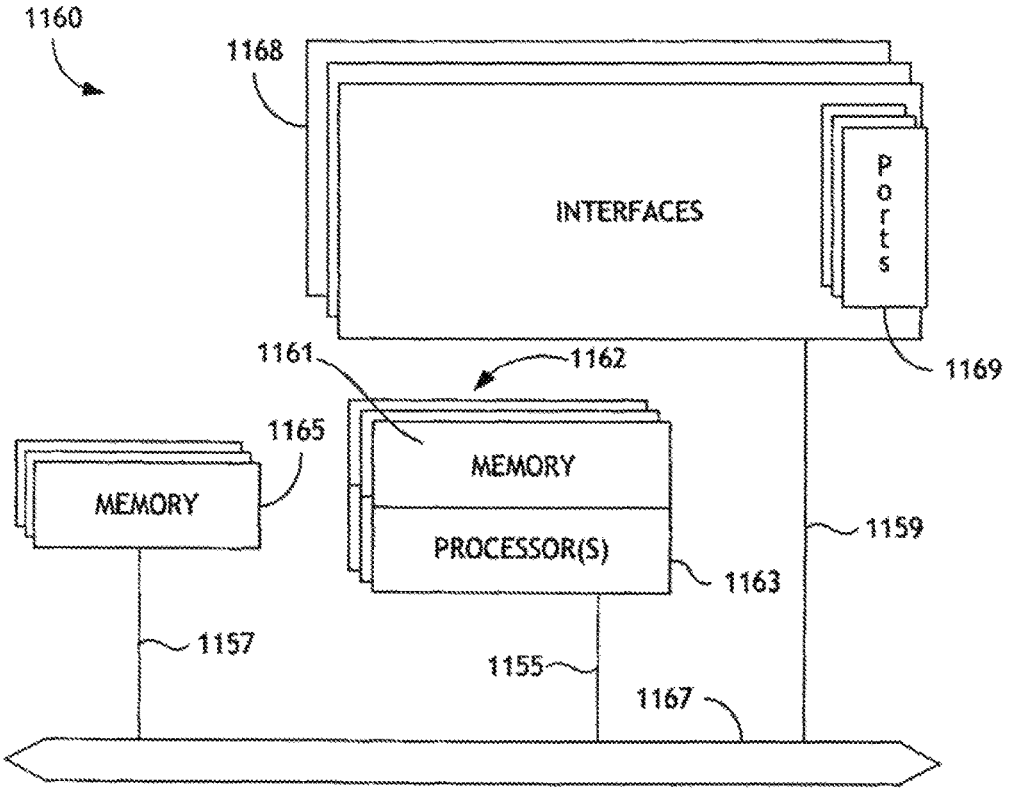
FIG. 1B shows another schematic for an electronic system for enabling play of the gaming method described herein.

FIG. 1B illustrates an example of a network device that may be configured for implementing some methods of the present invention. Network device 1160 includes a master central processing unit (CPU) 1162, interfaces 1168, and a bus 1167 (e.g., a PCI bus). Generally, interfaces 1168 include ports 1169 appropriate for communication with the appropriate media. In some embodiments, one or more of interfaces 1168 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 1168 control such communications-intensive tasks as encryption, decryption, compression, decompression, packetization, media control and management. By providing separate processors for the communications-intensive tasks, interfaces 1168 allow the master microprocessor 1162 efficiently to perform other functions such as routing computations, network diagnostics, security functions, etc.

The interfaces 1168 are typically provided as interface cards (sometimes referred to as "linecards"). Generally, interfaces 1168 control the sending and receiving of data packets over the network and sometimes support other peripherals used with the network device 1160. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1162 may be responsible for implementing specific functions associated with the functions of a desired network device. According to some embodiments, CPU 1162 accomplishes all these functions under the control of software including an operating system and any appropriate applications software.

CPU 1162 may include one or more processors 1163 such as a processor from the Motorola family of microprocessors or the MIPS family of microprocessors. In an alternative embodiment, processor 1163 is specially designed hardware for controlling the operations of network device 1160. In a specific embodiment, a memory 1161 (such as non-volatile RAM and/or ROM) also forms part of CPU 1162. However, there are many different ways in which memory could be coupled to the system. Memory block 1161 may be used for a variety of purposes such as, for example, caching and/or storing data, programming instructions, etc.

Regardless of network device's configuration, it may employ one or more memories or memory modules (such as, for example, memory block 1165) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 1B illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 1B) or switch fabric based (such as a cross-bar).

While this invention is described in terms of preferred embodiments, there are alterations, permutations, and equivalents that fall within the scope of the invention. It should also be noted that there are many alternative ways of implementing the present invention. It is therefore intended that the invention not be limited to the preferred embodiments described herein, but instead that the invention should be interpreted as including all such alterations, permutations, and equivalents as fall within the true spirit and scope of the present invention as described herein and set forth by the claims.

What is claimed is:

1. A method of providing a wagering game associated with an underlying game of Baccarat on a computerized gaming system, comprising a processor, a display device and a communication device, and memory, the processor being configured to execute a program stored in the memory actuating the steps of:

a) responsive to detecting a game wager received through the communication device, the processor, receiving a wager from a player relating to the associated wagering game in a designated area of a virtual gaming table surface displayed on the display device, wherein the wager is in the form of virtually displayed element representing a monetary amount;

b) the processor receiving Baccarat outcome data from an instance of conducting the underlying game of baccarat until a Baccarat outcome is achieved according to the rules of the Baccarat game, wherein the Baccarat outcome data includes a player hand score, a banker hand score, a number of playing cards in the player hand, and a number of cards in the banker hand upon the Baccarat outcome being achieved;

c) the processor comparing the Baccarat outcome data as received with preset criteria for determining the outcome of the associated wagering game, wherein the preset criteria includes satisfaction of at least one of the following: the banker hand score being six and having three playing cards in the banker hand irrespective of the Baccarat outcome data relating to the player hand; and the banker hand score and player hand score both being six and both the player hand and banker hand having three playing cards;

d) the processor facilitating the distribution of a payout to the player through the communication device responsive to the preset criteria being satisfied by the Baccarat outcome data; and e) the processor facilitating the collection of the wager virtually displayed responsive to the preset criteria not being satisfied by the Baccarat outcome data.

2. The method according to claim 1, wherein the underlying game of Baccarat is modified such that outcome of a banker hand wager in the underlying game is a push responsive to the banker hand score being four and the player hand score being three or less.

3. The method according to claim 1, wherein the underlying game of Baccarat is modified such that outcome of a banker hand wager in the underlying game is a win responsive to both the banker and player hands having two playing cards and hand scores of eight.

4. The method according to claim 1, wherein the underlying game of Baccarat is conducted using physical playing cards drawn from a randomly ordered group of standard physical playing cards.

5. The method according to claim 1, wherein the underlying game of Baccarat is conducted by using a random number generator mapped to simulate one or more decks of randomized standard physical playing cards.

6. The method according to claim 1, wherein the collection of the wager comprises virtually depicting removing the element received from the designated area on the displayed gaming table surface.

7. The method according to claim 1, wherein the distribution of a payout to the player comprises virtually depicting placing elements representing monetary amounts in the designated area of the displayed gaming table surface.

8. A method of providing a Baccarat wagering game with associated wagering game on a gaming device including a processor and display device with a player position in competition with a banker position, the player position and the banker position receiving playing cards from one or more decks of 52 playing cards, with eight decks, or 416 playing cards, being preferred, the method comprising:

an input device for receiving a monetary amount and detecting placement of an Baccarat wager from one or more participants, the Baccarat wager relating to the player position beating the banker position at the conclusion of a round of game play, the banker position beating the player position at the conclusion of the round of game play, or a tie between the player position and the banker position at the conclusion of the round of game play;

an input device for receiving a monetary amount and detecting placement of an associated game wager from one or more participants, the associated game wager relating to the play of an associated wagering game, wherein the preset criteria for determining the outcome of the associated wagering game includes satisfaction of at least one of the following: i) the banker hand score at the conclusion of the round of game play being six and having three playing cards in the banker hand without regard to one or both of the player hand score and the number of playing cards in the player hand; and ii) the banker hand score and player hand score at the conclusion of the round of game play both being six and both the player hand and banker hand having three playing cards;

the processor configured to provide two of the playing cards each to the player position and the banker position;

the processor configured to determine a value of each playing card provided during the round of play;

the processor configured to calculate a player position score based on a total value of the two physical playing cards provided to the player position and a banker position score based on a total value of the two playing cards dealt to the banker position;

the processor configured to determine whether an additional playing card will be provided to the player position based on the player position score and the banker position score, in accordance with the rules of Baccarat;

the processor configured for further determining whether an additional playing card will be provided to the banker position based on the player position score and the banker position score, in accordance with the rules of Baccarat;

the processor configured for resolving Baccarat wagers according to normal rules of Baccarat with at least one exception selected from the group consisting of:

no commission is collected when the banker hand wins;

when both player hand and banker hand have a natural 8, the banker hand wins; and when the banker hand final score is 4 and the player hand final score is 3 or less, a wager on the banker hand ties; and the processor configured for resolving associated game wagers through one of either distributing payout responsive to the preset criteria being satisfied by the Baccarat outcome or collecting the associated game wager detected.

9. The method according to claim 8 wherein the step of detecting placement of an associated wager further comprises detecting placement of an associated wager relating to one of either i) the banker hand score being six and having three playing cards in the banker hand without regard to one or both of the player hand score and the number of playing cards in the player hand or ii) the banker hand score and player hand score both being six and both the player hand and banker hand having three playing cards.

10. The method according to claim 9, wherein a first payout is distributed responsive to the satisfaction of the preset criteria of the banker hand score being six and having three playing cards in the banker hand without regard to one or both of the player hand score and the number of playing cards in the player hand and a second payout is distributed responsive to the satisfaction of the preset criteria of the banker hand score and player hand score both being six and both the player hand and banker hand having three playing cards.

11. The method according to claim 10, wherein the second payout is greater than the first payout.

12. The method according to claim 8, wherein a first payout is distributed responsive to the satisfaction of the preset criteria of the banker hand score being eight and both the banker hand and the player hand having three playing cards upon a Baccarat outcome of the banker hand score being greater than the player hand score, a second payout is distributed responsive to the satisfaction of the preset criteria of the banker hand score being eight and both the banker hand and the player hand having three playing cards upon an Baccarat outcome of the banker hand score being less than the player hand score, and a third payout is distributed responsive to the satisfaction of the preset criteria of the banker hand score being eight and both the banker hand and the player hand having three playing cards upon an Baccarat outcome of the banker hand score being the same as the player hand score.

13. The method according to claim 12, wherein the first payout is greater than each of the second and third payouts.

14. A system for providing a wagering game associated with an underlying game of Baccarat, comprising a memory configured to store a game program, a wager input device for receiving a monetary amount to be stored in memory as a credit balance and:

a) a processor configured to: (i) execute the program stored in memory responsive to detecting receipt of a game wager, the wager being deducted from the credit balance; and (ii) determine the outcome of the associated wagering game based on comparing Baccarat outcome data received with a preset criteria, wherein the Baccarat outcome data received relates to an instance of conducting a Baccarat game until a Baccarat outcome is achieved, the Baccarat outcome data including a player hand score, a banker hand score, a number of playing cards in the player hand, and a number of cards in the banker hand from the instance of the Baccarat game upon the Baccarat outcome being achieved, and wherein the preset criteria includes at least one of: the banker hand score being six and having three playing cards in the banker hand without any regard to any of the Baccarat outcome data relating to the player hand; and the banker hand score and player hand score both being six and both the player hand and banker hand having three playing cards; and b) a communication interface configured for:

i) receiving a wager relating to the associated wagering game;

ii) receiving Baccarat outcome data relating, wherein the baccarat outcome includes data relating to a player hand score, a banker hand score, the number of cards in the player hand, and the number of cards in the banker hand;

iii) transmitting a notification that the wager is being collected responsive to none of the preset criteria being satisfied by the comparison of the Baccarat outcome data with the preset criteria; and iv) facilitating a payout responsive to any of the preset criteria being satisfied by the comparison of the Baccarat outcome data with the preset criteria.

15. A system as recited in claim 12, wherein the processor conducts the underlying game of Baccarat until a Baccarat outcome is achieved according to the rules of the Baccarat game.

16. A system as recited in claim 12, wherein physical playing cards drawn from a randomly ordered group of standard physical playing cards to conduct the Baccarat game.

17. A system as recited in claim 12, further comprising a display configured for displaying the results of the wager in the associated wagering game.

18. A system as recited in claim 12, wherein the communication interface and processor are mounted in a unitary housing.

19. A system according to claim 12, wherein the processor is remotely located from the communication interface.

* * * * *